United States Patent [19]

Miettunen et al.

[11] Patent Number: 4,462,724

[45] Date of Patent: Jul. 31, 1984

[54] PHOTOCHEMICALLY MACHINED CUTTING WHEEL

[75] Inventors: Robert E. Miettunen, Athens; Kenneth H. Shaner, Towanda, both of Pa.

[73] Assignee: GTE Products Corporation, Stamford, Conn.

[21] Appl. No.: 411,212

[22] Filed: Aug. 25, 1982

[51] Int. Cl.[3] ..... B28D 1/04

[52] U.S. Cl. ..... 407/30; 51/73 R; 125/15; 407/48

[58] Field of Search ..... 51/73 R; 407/30, 31, 407/47, 48; 125/15

[56] References Cited

U.S. PATENT DOCUMENTS

| | | | |
|---|---|---|---|
| 3,175,548 | 3/1965 | Weiss | 51/73 |
| 3,324,539 | 6/1967 | Cleland | 51/73 |
| 3,329,138 | 7/1967 | Lupardo | 125/15 |
| 3,396,714 | 8/1968 | Lauze | 51/73 |
| 3,633,637 | 1/1972 | Kolesh | 125/15 |
| 3,955,551 | 5/1976 | Tang | 125/15 |

*Primary Examiner*—Leonidas Vlachos
*Assistant Examiner*—Jerry Kearns
*Attorney, Agent, or Firm*—James Theodosopoulos

[57] ABSTRACT

A cutting wheel comprises a thin metal disk having an inner peripheral cutting edge. The cutting wheel is photochemically machined from a flat metal sheet and has locating holes therethrough the diameters of which are held to a very close tolerance.

3 Claims, 3 Drawing Figures

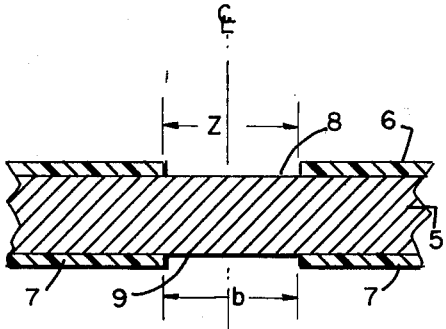
FIG. 2a
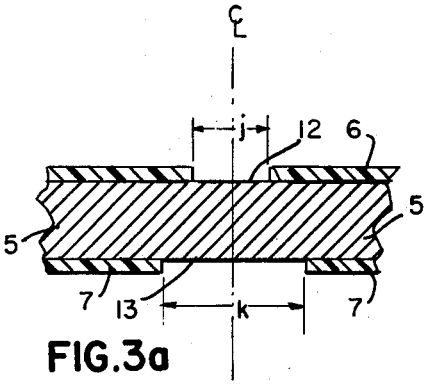
FIG. 3a
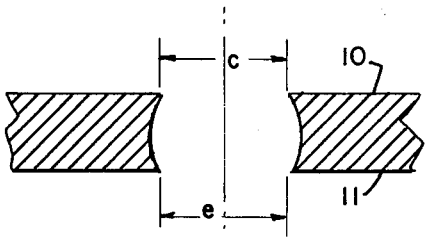
FIG. 2b
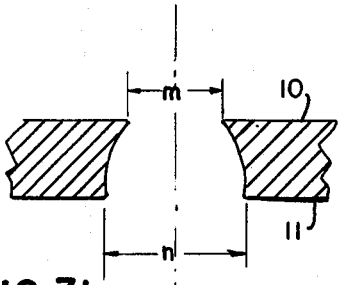
FIG. 3b
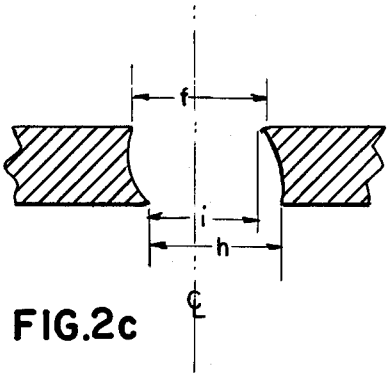
FIG. 2c
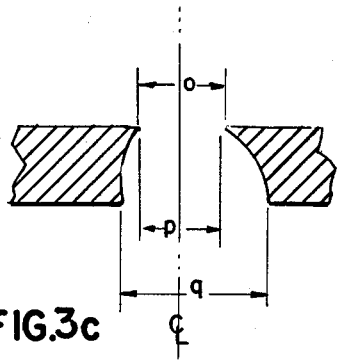
FIG. 3c
FIG. 2
FIG. 3

PHOTOCHEMICALLY MACHINED CUTTING WHEEL

This invention concerns annular cutting wheels having a cutting edge on the inner peripheral portion thereof. Such cutting wheels are shown in U.S. Pat. Nos. 3,039,235, 3,117,398, 3,175,548, 3,288,128, 3,324,539, 3,396,714, 3,827,421, 4,084,354, 4,150,912 and 4,151,826. Generally, such cutting wheels have been stamped from flat metal sheets.

Recently, photochemical machining has been used to make such cutting wheels. Photochemical machining is shown in U.S. Pat. Nos. 3,446,408, 3,608,696, 3,769,111, 3,875,900, 3,877,418 and 3,897,251, and involves the etching away of preselected portions of a flat metal sheet, the remaining portions of the sheet being protected from the etchant by a suitable protective coating. Photochemically machined cutting wheels offer some advantages relating to surface imperfections, flatness and internal stress over stamped cutting wheels. However a problem exists with photochemically machined cutting wheels. This problem relates to the fact that a suitably patterned protective coating is placed on both sides of the flat metal sheet and etching is then performed on both sides, also. The problem is in the alignment of the patterns on both sides with each other.

A cutting wheel has, say, three locating holes therethrough that are used in accurately positioning the cutting wheel in cutting apparatus. A narrow tolerance, say, about 0.0001 inch, is required for the diameter of each hole. If the patterns are misaligned by, say, two or three ten-thousandths of an inch, then the diameter of the hole cannot be controlled to 0.0001 inch.

This invention solves the misalignment problem by making the hole in the pattern on one side of the metal sheet slightly larger than the corresponding hole in the pattern on the other side of the metal sheet.

In the drawing,

FIGS. 2 and 3 are expanded sectional illustrations of the locating holes in the cutting wheel.

Figure 1:
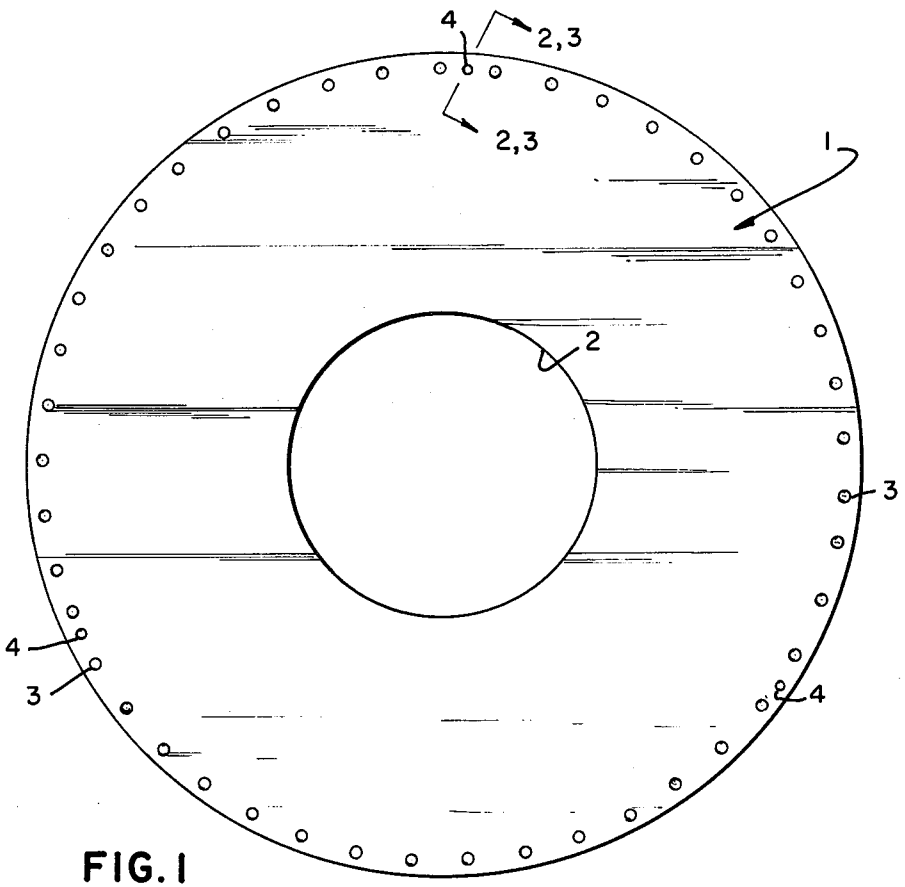
FIG. 1 shows a cutting wheel in accordance with this invention.

In one example, as shown in FIG. 1, a cutting wheel 1 in accordance with this invention was made of 6 mil thick stainless steel and had an outer diameter of 22 inches and an inner diameter of 8 inches. Inner periphery 2 is the cutting edge of the wheel. There were forty-five holes 3 through the wheel near the outer periphery thereof. Holes 3 are used to fasten wheel 1 within suitable cutting apparatus securely enough so that inner periphery 2 can be placed under great tension during cutting. There were three locating holes 4 through the wheel, also near the outer periphery thereof. In order that wheel 1 be accurately located with respect to the work to be cut, the diameter of holes 4 must be carefully controlled. In the example, the diameter of holes 4 was 0.3126 inches with a tolerance of plus or minus 0.0001 inch. FIGS. 2 and 3 illustrate how the diameter was attained.

In FIG. 2*a* there is shown a section 5 of a cutting wheel 1 with etchant-resistant coatings 6 and 7 on either surface thereof. There is a hole 8 of diameter z through coating 6 and a hole 9 of diameter b through coating 7. FIG. 2*b* shows section 5 after etching therethrough and after coatings 6 and 7 have been removed. The diameter of the hole through section 5 increases slightly towards the midpoint of the section, because of the etching process, and is a minimum at the surfaces of section 5, shown in FIG. 2*b* as diameters c and e. FIG. 2*b* shows the situation when holes 8 and 9 in FIG. 2*a* are perfectly aligned. FIG. 2*c* shows the situation when holes 8 and 9 are slightly misaligned. Diameters f and h in FIG. 2*c* are still equal to diameters c and e, respectively, in FIG. 2*b*, but the effective minimum diameter no longer equals diameter c(or f). The effective minimum diameter is now diameter i, which is less than diameter c (or diameter f), a result of the misalignment of holes 8 and 9.

FIG. 3 shows how the misalignment problem is solved. In FIG. 3*a*, diameter j equals diameter z in FIG. 2*a*, but diameter k is slightly larger than diameter b. When holes 12 and 13 are perfectly aligned, i.e. coaxial, diameter m in FIG. 3*b* equals diameter c in FIG. 2*b*, and diameter n is larger than diameter e.

But when holes 12 and 13 are misaligned, the results are shown in FIG. 3*c*. The minimum effective diameter is diameter p, which still equals diameter m and c. Diameter o equals diameter m, and diameter q equals diameter n. For this purpose, it is necessary that the diameter of hole 13 exceed the diameter of hole 12 by an amount that is greater than the tolerance of misalignment of holes 12 and 13.

In this example, the desired diameter for locating holes 4 was 0.3126 inches plus or minus 0.0001 inch, which is what diameters c, m and p equalled. Diameter j was 0.3088 inches and diameter k was 0.3103 inches, which are less than the desired diameter, but in the process of etching through metal section 5, the diameter of the hole etched therethrough is greater than the diameters of holes 8, 9 and 12, 13 in coating 6. In FIG. 3*c*, diameter o was 0.3126 inches and diameter q was 0.3136 inches.

The methods of depositing coating on metal sheeting, forming patterns thereon, removing selected portions of coating, etching, then removing the coating, are shown in the aforementioned photochemical machining patents and are incorporated herein by reference.

We claim:

1. A photochemically machined cutting wheel comprising a thin flat metal disk having an inner peripheral cutting edge and having a plurality of locating holes through the disk, the diameter of the holes at one surface of the disk being slightly larger than the diameter thereof at the other surface of the disk, the arrangement of said hole diameters at said surfaces being such as to provide a close tolerance on minimum hole diameters during manufacture of said wheel in order to provide accurate positioning of the wheel during cutting.

2. The disk of claim 1 having three such locating holes.

3. The disk of claim 2 wherein the outer diameter of the disk is 22 inches, the diameter of the peripheral cutting edge is 8 inches, and the minimum hole diameter is 0.3126 inches plus or minus 0.0001 inches.

* * * * *